US011136151B1

(12) United States Patent
Baker

(10) Patent No.: US 11,136,151 B1
(45) Date of Patent: Oct. 5, 2021

(54) ORBITAL WRAPPING MACHINE

(71) Applicant: Michael Baker, Byron Center, MI (US)

(72) Inventor: Michael Baker, Byron Center, MI (US)

( * ) Notice: Subject to any disclaimer, the term of this patent is extended or adjusted under 35 U.S.C. 154(b) by 58 days.

(21) Appl. No.: 16/390,749

(22) Filed: Apr. 22, 2019

Related U.S. Application Data

(60) Provisional application No. 62/661,231, filed on Apr. 23, 2018.

(51) Int. Cl.
*B65B 11/00* (2006.01)

(52) U.S. Cl.
CPC ..... *B65B 11/008* (2013.01)

(58) Field of Classification Search
CPC ..... B65B 11/008; B65B 11/025; B65B 11/38; B65B 11/58; B65B 11/585; B65B 2210/18; B65B 2011/002; B65B 13/00; B65B 13/04; B65B 13/10; B65B 13/14; B65H 16/00; B65H 16/005; B65H 16/028; B65H 16/024; B65H 16/023; B65H 16/103; B65H 2301/44921; B65H 2404/531; B65H 2404/5311; B65H 23/08; B65H 23/085; B65H 23/06
USPC ..... 53/588, 556, 441, 399, 210, 449, 465, 53/589, 203, 591
See application file for complete search history.

(56) References Cited

U.S. PATENT DOCUMENTS 2,963,236 A * 12/1960 Grosser ..... B65B 41/12 242/421.2
3,602,452 A * 8/1971 Sauer ..... B65H 23/08 242/421.8
3,669,376 A * 6/1972 Lucas ..... B65H 23/063 242/421.2
3,720,385 A * 3/1973 Staats ..... B65H 23/06 242/421.2
3,813,052 A * 5/1974 Swann ..... B65H 23/085 242/420.3
3,841,055 A * 10/1974 Takami ..... B65B 13/32 53/589
3,912,189 A * 10/1975 Bauer ..... B65H 23/16 242/417.3
4,044,529 A * 8/1977 Zelnick ..... B65B 9/026 53/548
4,050,221 A * 9/1977 Lancaster, III ..... B65B 11/045 53/211
4,079,565 A * 3/1978 Lancaster, III ..... B65B 11/025 53/397
4,110,957 A * 9/1978 Lancaster ..... B65B 11/025 100/28

(Continued)

*Primary Examiner* — Dariush Seif
(74) *Attorney, Agent, or Firm* — Gardner, Linn, Burkhart & Ondersma LLP

(57) ABSTRACT

An orbital wrapping machine includes a rotatable wrapping wheel and a drive system, with one or more roll mounts arranged circumferentially around the wrapping wheel and each configured to rotatably support a roll of stretch film. Rotation of the wrapping wheel about an object causes the stretch film to be wrapped around the object. A tensioning system applies a frictional resistance to rotation of each roll of stretch film as the firm is drawn off each roll during rotation of the wrapping wheel. The tensioning system includes a friction material and an adjuster that is capable of urging the friction material against an outer surface of the roll of stretch film at different levels of pressure to adjust the frictional resistance of each roll of stretch film.

15 Claims, 10 Drawing Sheets

(56) References Cited

U.S. PATENT DOCUMENTS 4,166,348 A * 9/1979 Carlson ..... B65B 11/04 53/210
4,176,805 A * 12/1979 Jackson ..... B65H 23/06 188/195
4,178,734 A * 12/1979 Lancaster ..... B65B 53/00 53/399
4,232,501 A * 11/1980 Stackhouse ..... B65B 11/045 53/399
4,302,920 A * 12/1981 Lancaster ..... B65B 11/045 264/288.4
4,317,322 A * 3/1982 Lancaster ..... B65B 11/008 53/399
4,418,510 A * 12/1983 Lancaster, III ..... B65B 11/04 53/399
4,422,592 A * 12/1983 Swope ..... B41J 33/52 101/27
4,448,363 A * 5/1984 Mukenschnabl ..... B65H 16/08 242/422.6
4,484,717 A * 11/1984 Goldstein ..... B65B 67/085 188/67
4,524,568 A * 6/1985 Lancaster ..... B65B 11/008 53/441
4,545,182 A * 10/1985 McDowell, Jr. ..... B65B 13/10 53/556
4,549,388 A * 10/1985 Lancaster ..... B65B 51/225 53/210
4,553,374 A * 11/1985 Lancaster ..... B65B 11/008 53/210
4,593,518 A * 6/1986 Lancaster ..... B65B 61/10 53/210
4,610,403 A * 9/1986 Goekler ..... B65B 11/008 156/428
4,610,407 A * 9/1986 Stubbmann ..... B65H 16/005 242/421.3
4,631,898 A * 12/1986 Brambilla ..... B65B 11/025 53/399
4,676,048 A * 6/1987 Lancaster ..... B65B 11/008 53/210
4,712,354 A * 12/1987 Lancaster ..... B65B 11/008 53/176
4,723,393 A * 2/1988 Silbernagel ..... B65B 11/008 53/556
4,761,934 A * 8/1988 Lancaster ..... B65B 11/025 269/139
4,840,006 A * 6/1989 Humphrey ..... B65B 11/045 53/556
4,850,177 A * 7/1989 Kaczkowski ..... B65B 13/12 53/556
4,862,678 A * 9/1989 Humphrey ..... B65B 11/045 53/556
4,866,909 A * 9/1989 Lancaster, III ..... B65B 11/008 53/399
4,898,336 A * 2/1990 Reist ..... B65H 29/66 242/528
4,953,336 A * 9/1990 Lancaster, III ..... B65B 11/008 53/176
4,993,209 A * 2/1991 Haloila ..... B29C 65/7471 53/373.9
5,086,610 A * 2/1992 Maki-Rahkola ..... B65B 11/04 53/211
5,174,518 A * 12/1992 Hongo ..... B41J 15/04 242/422.5
5,279,472 A * 1/1994 Hongo ..... B65H 16/02 242/422.5
5,285,891 A * 2/1994 Keip ..... B65B 11/008 198/817
5,311,725 A * 5/1994 Martin ..... B65B 11/025 53/556
5,404,691 A * 4/1995 Scherer ..... B65B 11/025 53/399
5,423,163 A * 6/1995 Wendt ..... B65B 11/025 53/556
5,505,042 A * 4/1996 Keip ..... B65B 11/008 226/196.1
5,581,979 A * 12/1996 Scherer ..... B65H 23/14 53/389.4
5,755,083 A * 5/1998 Cleine ..... B65B 25/24 53/588
5,967,445 A * 10/1999 Yuyama ..... B65H 16/04 242/421.1
6,006,498 A * 12/1999 Cleine ..... B65B 11/04 53/441
6,068,209 A * 5/2000 Nakamura ..... B65H 23/063 242/160.1
6,195,961 B1 * 3/2001 Turfan ..... B65B 11/025 53/389.2
6,230,857 B1 * 5/2001 Ciriello ..... B65H 23/06 188/250 E
6,370,839 B1 * 4/2002 Nakagawa ..... B65B 11/008 52/211
6,393,797 B1 * 5/2002 Romes ..... B65H 16/00 242/566
6,595,455 B2 * 7/2003 Romes ..... B65H 16/08 242/422.5
6,651,408 B1 * 11/2003 McClure ..... A01F 15/0715 242/421.2
6,729,106 B2 * 5/2004 Wiley ..... B65B 11/008 53/399
6,745,544 B2 * 6/2004 Matsumoto ..... B65B 11/006 53/176
6,826,893 B2 * 12/2004 Cere' ..... B65B 11/025 53/556
6,880,316 B2 * 4/2005 Lancaster, III ..... B65B 11/008 100/13
7,134,260 B2 * 11/2006 Haloila ..... B65B 11/025 53/588
7,516,694 B1 * 4/2009 Eifler ..... B65B 27/10 100/27
7,530,526 B1 * 5/2009 Powers ..... A47K 10/38 242/422.5
7,556,129 B2 * 7/2009 Nix ..... B65B 13/187 188/72.9
7,644,563 B2 * 1/2010 De Gersem ..... A01F 15/0715 53/587
7,937,915 B2 * 5/2011 Kohn ..... B65B 67/085 53/556
8,079,201 B2 * 12/2011 Cere ..... B65B 11/585 53/399
8,490,366 B1 * 7/2013 Hintz ..... A01F 15/0715 53/64
9,206,007 B2 * 12/2015 Helseth ..... B65H 16/005
9,624,059 B2 * 4/2017 Wilfong ..... B65H 16/005
10,005,580 B2 * 6/2018 Lancaster, III ..... B65B 11/025
10,005,581 B2 * 6/2018 Lancaster, III ..... B65B 11/025
10,023,334 B2 * 7/2018 Schwartz ..... B65H 81/08
10,045,669 B2 * 8/2018 Morand ..... A47K 10/38
2002/0050543 A1 * 5/2002 Romes ..... B65H 16/08 242/422.5
2002/0102122 A1 * 8/2002 Hierro ..... B65H 23/06 400/618
2002/0174628 A1 * 11/2002 Lancaster, III ..... B65B 11/025 53/441
2002/0189210 A1 * 12/2002 Wiley ..... B65B 11/008 53/556
2003/0145563 A1 * 8/2003 Cere' ..... B65B 11/025 53/588
2003/0172629 A1 * 9/2003 Viaud ..... A01F 15/0715 53/588
2005/0016130 A1 * 1/2005 Matsumoto ..... B65B 63/026 53/439
2006/0156694 A1 * 7/2006 Aubin ..... B65B 11/008 53/447
2006/0243848 A1 * 11/2006 Cano ..... B65H 23/085 242/422.9
2007/0095026 A1 * 5/2007 Moser ..... B65B 67/08 53/556
2007/0157556 A1 * 7/2007 Feraboli ..... A01F 15/0715 53/399

(56) References Cited

U.S. PATENT DOCUMENTS

| | | | | |
|---|---|---|---|---|
| 2007/0220840 | A1* | 9/2007 | Pecchenini | B65B 11/008 53/588 |
| 2008/0135673 | A1* | 6/2008 | Sato | B65H 16/02 242/590 |
| 2008/0184676 | A1* | 8/2008 | Downhill | B65B 11/008 53/465 |
| 2010/0031610 | A1* | 2/2010 | Smith | B65B 67/085 53/465 |
| 2011/0179752 | A1* | 7/2011 | Lancaster, III | B65B 11/025 53/441 |
| 2012/0024884 | A1* | 2/2012 | Wilfong | B65H 16/005 221/30 |
| 2012/0102888 | A1* | 5/2012 | Downhill | B65B 41/16 53/461 |
| 2012/0180430 | A1* | 7/2012 | Lavoie | A01F 25/14 53/203 |
| 2012/0199019 | A1* | 8/2012 | Kenney | B65B 13/04 100/2 |
| 2012/0260609 | A1* | 10/2012 | Kivela | B65B 11/008 53/461 |
| 2013/0134181 | A1* | 5/2013 | Helseth | B65H 35/10 221/26 |
| 2014/0208696 | A1* | 7/2014 | Phillips | B65B 41/12 53/461 |
| 2015/0259087 | A1* | 9/2015 | Schwartz | B65H 81/00 53/556 |
| 2015/0360800 | A1* | 12/2015 | Shelander | B65B 11/025 53/399 |
| 2018/0229867 | A1* | 8/2018 | Brizek | B65B 11/008 |
| 2018/0249637 | A1* | 9/2018 | Kraus | B65B 13/22 |
| 2018/0334274 | A1* | 11/2018 | Brizek | B65B 11/008 |

* cited by examiner

ORBITAL WRAPPING MACHINE

FIELD OF THE INVENTION

The present application claims the benefit of U.S. provisional application Ser. No. 62/661,231, filed Apr. 23, 2018, which is hereby incorporated herein by reference in its entirety.

FIELD OF THE INVENTION

The present invention relates to devices for wrapping film material around products, such as for wrapping stretch film material around one or more goods supported on a shipping pallet.

BACKGROUND OF THE INVENTION

Large products or collections of smaller products are often shipped and at least temporarily stored on shipping pallets that facilitate handling with a forklift. It is often desirable to wrap the products with stretch film material in order to hold them together during handling, and optionally to provide weather resistance with a waterproof layer of film covering the products. Typically the pallet-supported product(s) are rotated relative to a stretch film dispenser so that the stretch film is wrapped around the product(s) (and optionally also the pallet on which they are supported) in a continuous spiral pattern. The tension applied to the stretch film during wrapping affects the amount of stretch film used, and also affects how effectively the stretch film layer secures a group of products together and/or the effectiveness of the weather-resistant barrier formed by the stretch film. Some pallet wrapping devices employ costly sensors and powered actuators to achieve desirable tension in the stretch film during its application to palletized products. In addition, there are larger and smaller wrapping applications for products or articles (such as furniture, collections of vehicle parts, etc.) that are not necessarily supported on pallets, but in which similar wrapping with plastic film or stretch film material is uses to at least temporarily secure and/or protect the products or articles.

SUMMARY OF THE INVENTION

The present invention is an orbital wrapping machine, such as a pallet wrapper, that is capable of wrapping products (including palletized products) with stretch film at a suitable tension level, with relatively low-cost manual tension adjustment capability for the stretch film. This allows users to wrap a product or group of products in a cost effective manner, by allowing a user to quickly set the tension that will be applied to stretch film material as it is drawn off of rolls. The tension-setting mechanisms are easily serviced as needed, and low complexity helps to ensure reliable operation and short service times.

According to one form of the present invention, an orbital wrapping machine includes a wrapping wheel rotatably supported on a base, a drive system for rotating the wrapping wheel, a roll mount, and a film tensioning system. The wrapping wheel defines an interior wrapping chamber for receiving an object to be wrapped. The roll mount is positioned along the wrapping wheel and rotatably supports a roll of stretch film while permitting the roll to rotate about a roll rotation axis. The film tensioning system includes a friction material and a manual adjuster. The friction material is spaced from the roll rotation axis and engages an outer surface of the roll of stretch film at varying levels of pressure in response to the manual adjuster. The pressure of the friction material against the outer surface of the roll changes the frictional resistance to rotation of the roll as the stretch film is drawn off of the roll during a wrapping operation.

In one aspect, the friction material is in the form of an elongate strip having opposite ends positioned at opposite sides of the roll mount and the roll rotation axis, with a middle portion that engages the outer surface of the roll of stretch film.

In another aspect, the manual adjuster is a tensioner having a first end coupled to the wrapping wheel and a second end coupled to one of the ends of the friction material. The tensioner is operable to increase and decrease tension in the elongate strip.

In yet another aspect, the tensioner includes an elastic member and a length-adjustable member, configured so that the elastic member stretches in response to shortening of the length-adjustable member.

In still another aspect, the support base has a plurality of idler wheels that support the wrapping wheel, and the drive system includes at least one powered drive wheel for rotatably driving the wrapping wheel. Optionally, the drive system includes a drive motor at the support base, which drive motor is operable to rotatably drive the drive wheel.

According to another form of the present invention, an orbital wrapping machine includes a wrapping wheel, a drive system, a roll mount, and a film tensioning system. The wrapping wheel defines an interior wrapping chamber and a wheel axis through the wrapping chamber. The drive system rotates the wrapping wheel about the wheel axis. The roll mount is positioned along the wrapping wheel and is configured to rotatably support a roll of stretch film along a roll axis. The film tensioning system is positioned at the roll mount and includes an elongate strip of friction material and a manual tension adjuster. The strip of friction material has opposite ends coupled to the wrapping wheel at opposite sides of the roll axis, and further includes a middle portion for engaging an outer surface of the roll of stretch film. The manual tension adjuster is coupled to the elongate strip of friction material and is used to selectively increase tension in strip of friction material to thereby urge the middle portion friction material against the outer surface of the roll of stretch film at different levels of pressure when the roll of stretch film is rotatably supported at the roll mount.

Therefore, the orbital wrapping machine provides an economical device for applying stretch film at a desired tension level to objects or articles that pass through a rotatable wrapping wheel, with relatively low-cost manual tension adjustment capability for the stretch film. A user can quickly set the desired tension, and can readily service the wrapping machine as needed.

These and other objects, advantages, purposes and features of the present invention will become apparent upon review of the following specification in conjunction with the drawings.

DESCRIPTION OF THE PREFERRED EMBODIMENT

Figure 1:
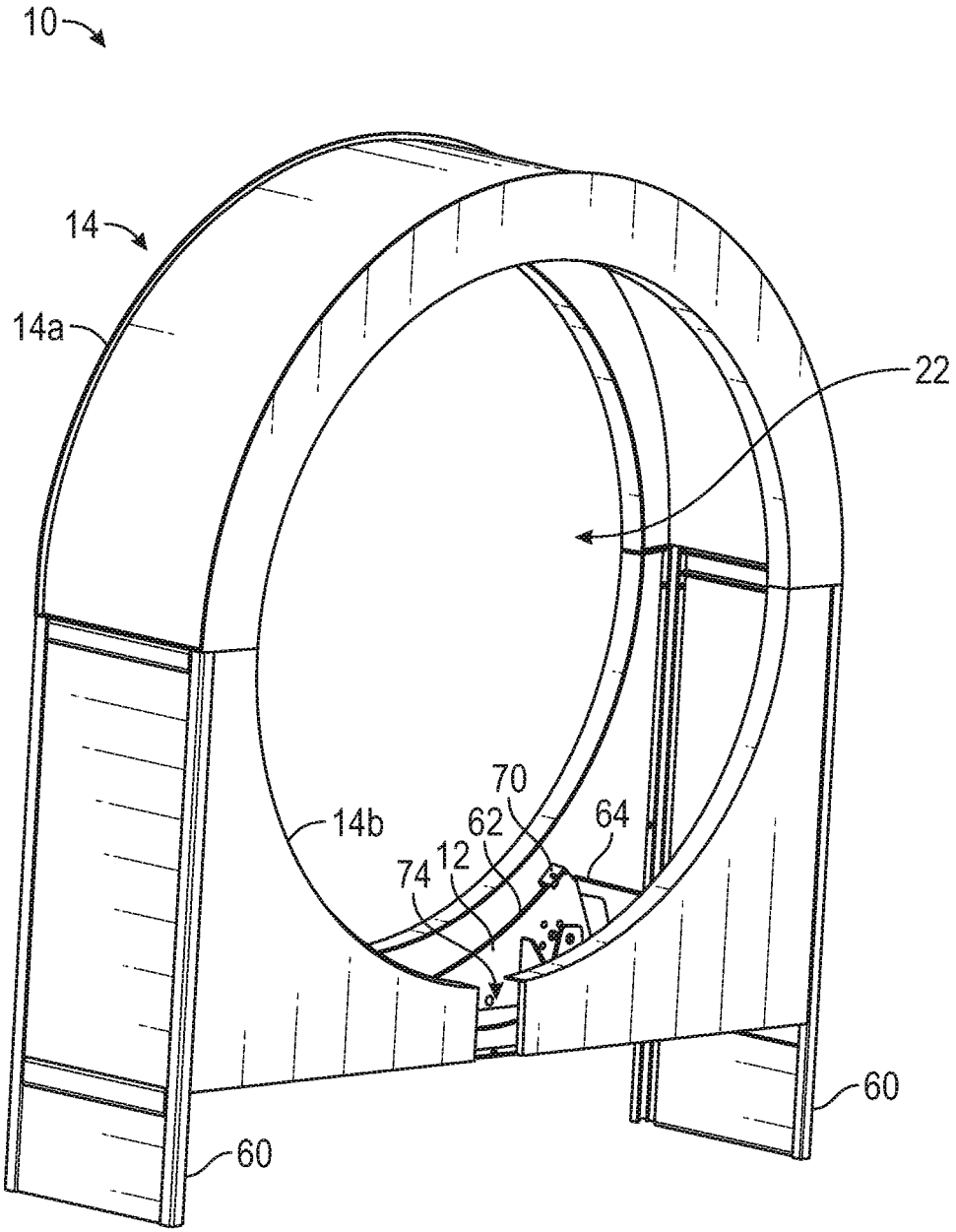
FIG. 1 is a perspective view of the outer housing and wheel-support base of an orbital wrapping machine in accordance with the present invention.
Figure 3:
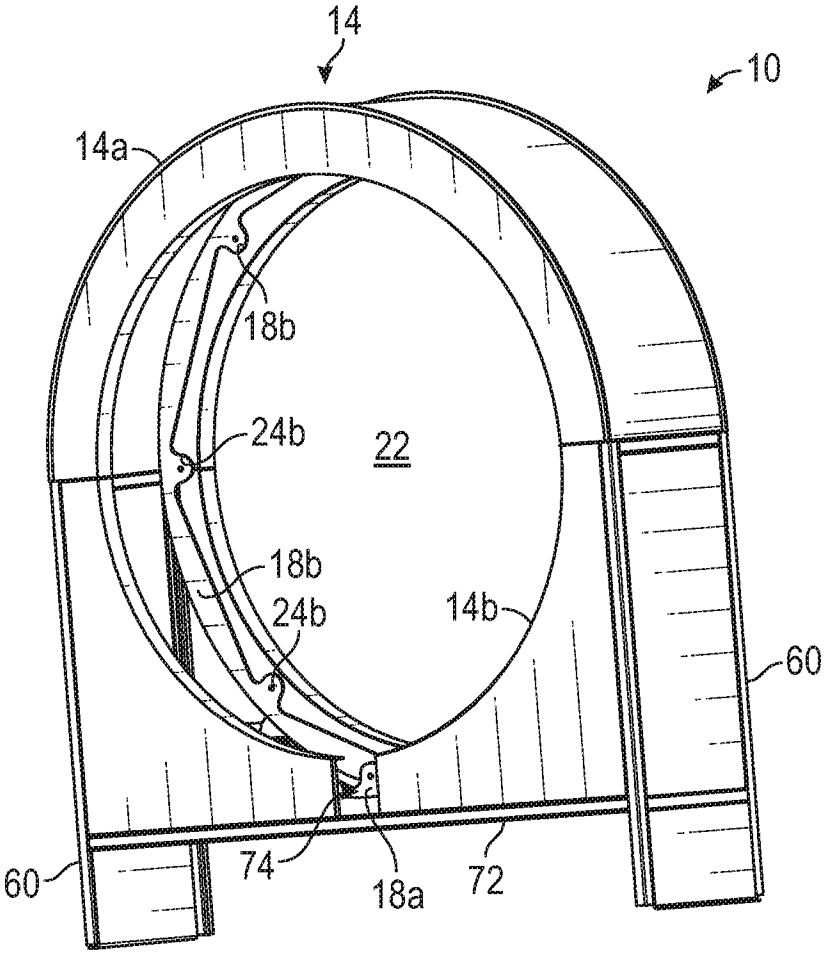
FIG. 3 is a perspective view of the outer housing and wheel-support base of FIG. 1, with a wheel portion shown inside the outer housing.
Figure 2:
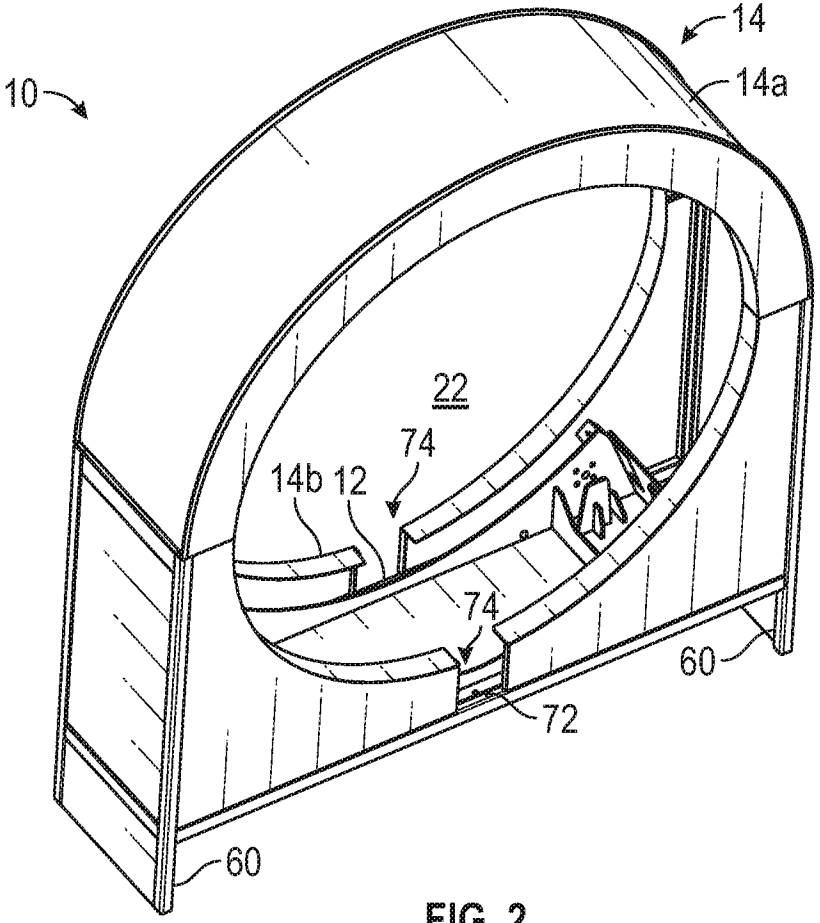
FIG. 2 is a top perspective view of the outer housing and wheel-support base of FIG. 1.
Figure 4:
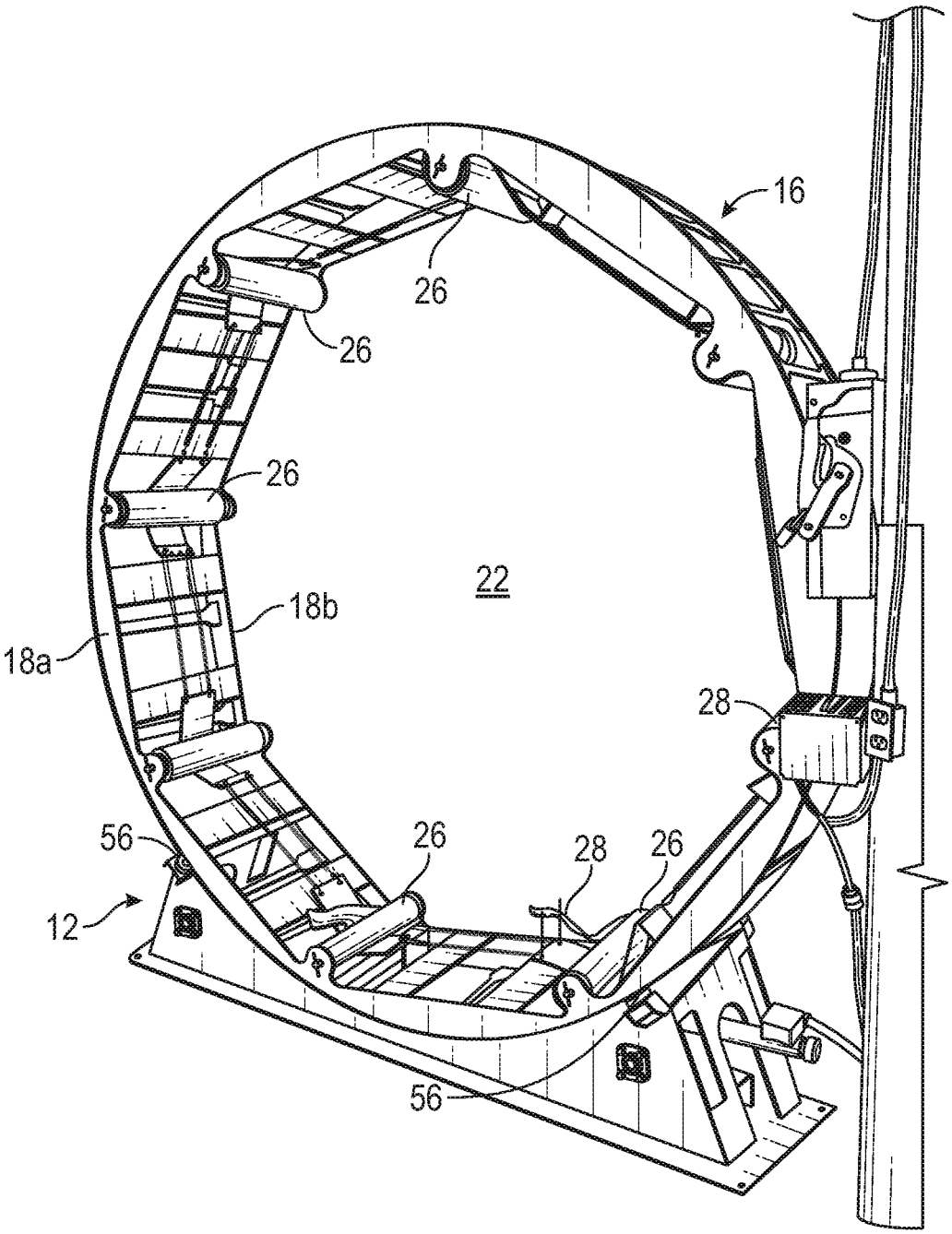
FIG. 4 is a perspective view of a wrapping wheel of the orbital wrapping machine, shown supported at a wheel-support base.
Figure 5:
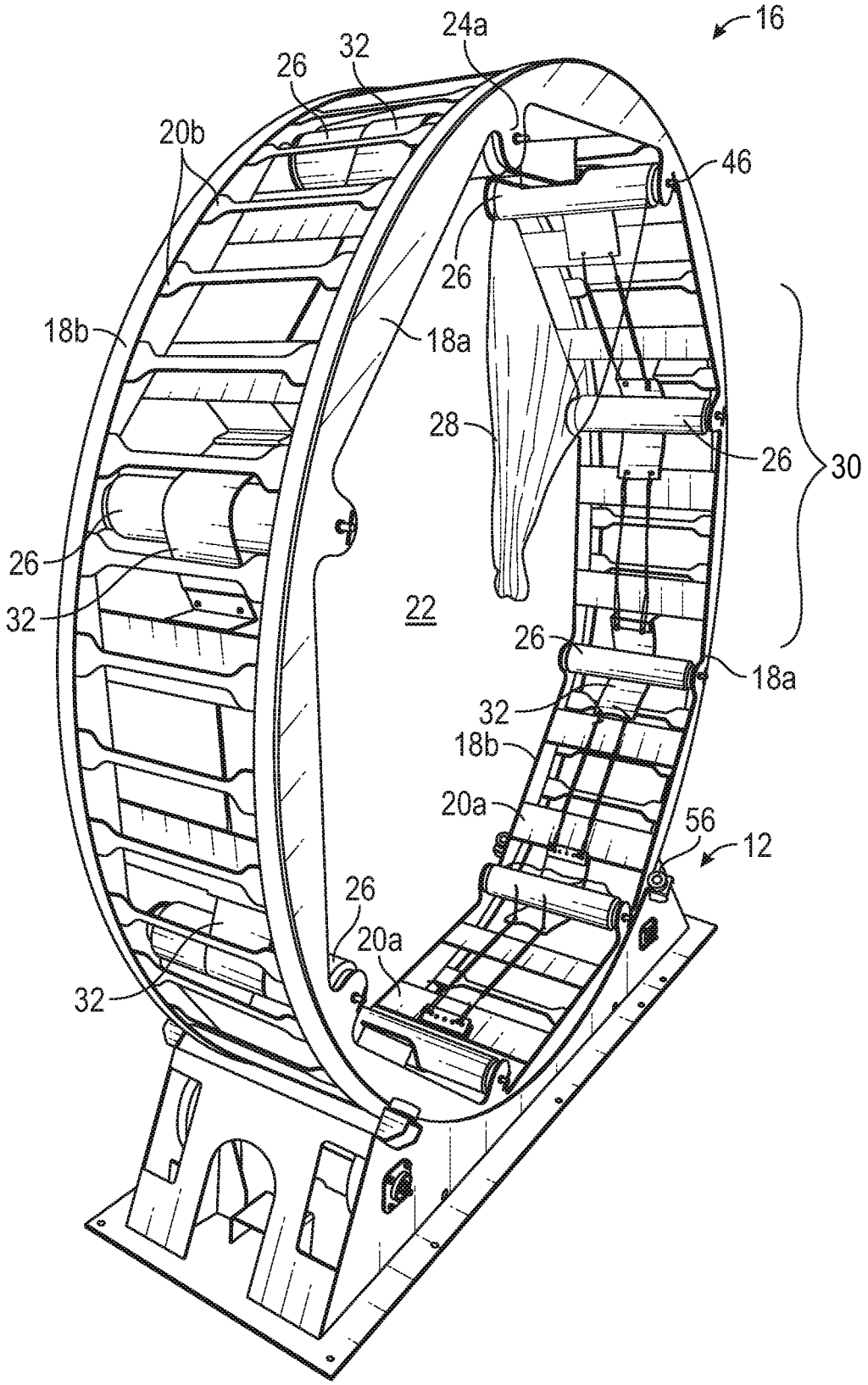
FIG. 5 is another perspective view of the wrapping wheel and wheel-support base of FIG. 4.

Referring now to the drawings and the illustrative embodiment depicted therein, an orbital wrapping machine 10 includes a support base 12 mounted in a wheel housing 14, such as shown in FIGS. 1-3. It should be appreciated that, to provide clearer views of the various structures, different portions of the orbital wrapping machine 10 are omitted from each drawing. A wrapping wheel 16 is rotatably supported on support base 12 in the wheel housing 14, and includes a pair of generally circular loops 18*a*, 18*b* that are spaced apart from one another and aligned substantially coaxially such as shown in FIGS. 4 and 5. The circular loops 18*a*, 18*b* are coupled together by a plurality of inner wheel brackets 20*a* and a plurality of outer wheel brackets 20*b*, such as shown in FIGS. 3-10. Wrapping wheel 16 defines an interior wrapping chamber 22 that, in the illustrated embodiment, is sufficiently large to receive a standard shipping/storage pallet (not shown) and the products supported thereon. A plurality of roll mounts 24 are circumferentially spaced along wrapping wheel 16, with respective pairs of roll mount portions 24*a*, 24*b* formed along respective ones of the circular loops 18*a*, 18*b* and located opposite one another (FIGS. 4-10). Each roll mount 24 rotatably supports a stretch film roll 26 with its longitudinal axis aligned substantially parallel to the rotational axis of wrapping wheel 16, so that as the wrapping wheel 16 spins on support base 12, stretch film 28 unspools from each roll 26 so that the stretch film 28 wraps around the article(s) or the pallet and its contents located in the wrapping chamber 22.

A manually-adjustable film tensioning system 30 is provided along the wrapping wheel 16, near each roll mount 24 (FIGS. 5 and 8), to impart appropriate or desired tension in the stretch film 28 as it is wrapped around the article(s) or the pallet and its contents. Film tensioning system 30 includes a flexible elongate strip of friction material 32, which is positioned so as to have its opposite ends 32*a*, 32*b* positioned at opposite sides of the roll mount 24 and the stretch film roll 26. The film tensioning system 30 further includes a manually adjustable tensioner 34 having a first end portion 34*a* coupled to the wrapping wheel 16 and a second (opposite) end portion coupled to the first end 32*a* of the friction material 32. The tensioning system 30 operates to apply a desired level or degree of tension or tensile load in the friction material 32 as the friction material is drawn off of the roll 26. This is achieved by the friction material 32 frictionally engaging the outermost layer of stretch film 28 on the outboard side of the spinning stretch film roll 26 as the wrapping wheel 16 rotates.

In the illustrated embodiment, the adjustable tensioner 34 includes an elastic portion in the form of a pair of stretchable coil springs 36, and a length-adjustable portion in the form of nylon cable ties (also known as "zip ties") 38. Coil springs 36 stretch in response to shortening of the respective cable ties 38, which also causes the tension to increase in the adjustable tensioner 34 and the friction material 32. It will be appreciated that many different devices or products may be substituted for coil springs 36 and cable ties 38. For example, rubber bungee cords having exposed elastic rubber or elastic elements wrapped in a cloth or fiber outer casing may be substituted for coil springs. It is further envisioned that a compressed gas spring may be substituted for coil springs, albeit at potentially higher cost. Suitable substitutes for cable ties 38 may include, for example, straps of woven webbing material combined with length-adjustment buckles, a turnbuckle system, threaded components, a ratchet-cable system, or substantially any other length-adjustable coupling device. Optionally, it is envisioned that an adjustable tensioner may combine resilient qualities with adjustable length, in order to reduce the part count of the adjustable tensioner. For example, a stretchable woven webbing material wound on a retractor spool may provide sufficient tension and adjustability for the friction material 32.

Figure 9:
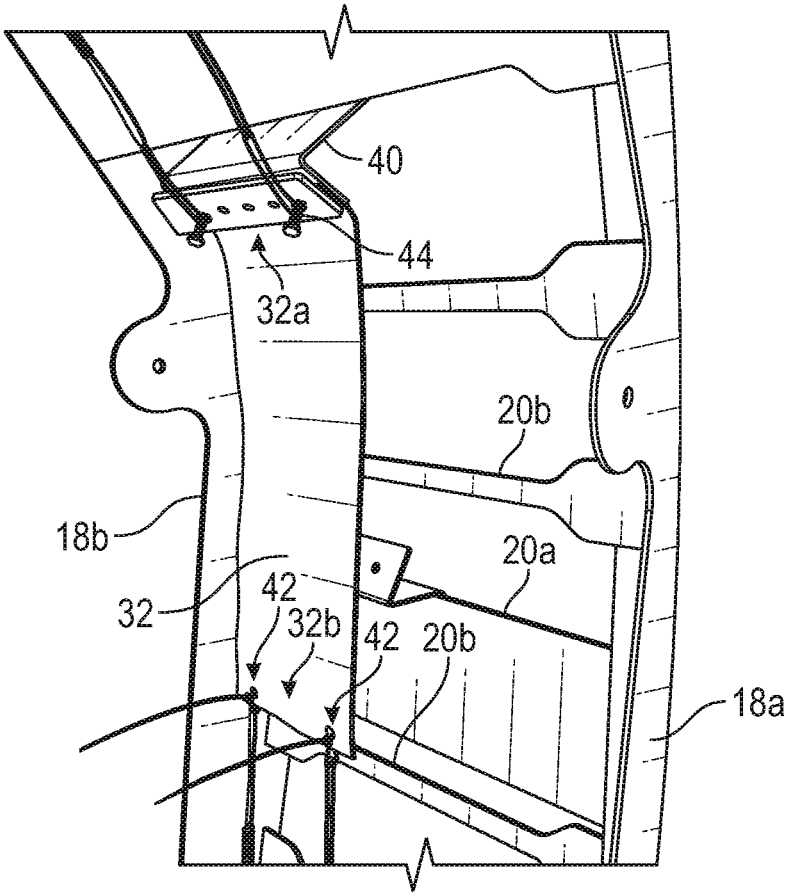
FIG. 9 is a side perspective view of the tensioning system of FIGS. 6-8, shown with the stretch film roll removed.
Figure 10:
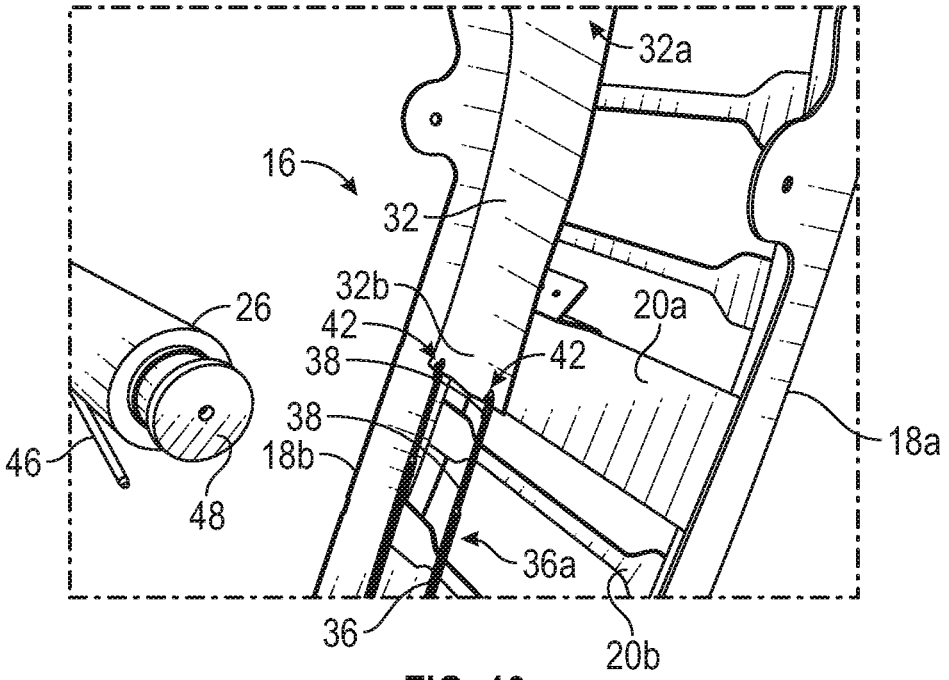
FIG. 10 is another side perspective view of the tensioning system of FIGS. 6-8, shown with a stretch film roll prior to mounting along the wrapping wheel.

With a stretch film roll 26 mounted at a roll mount 24, the adjustable tensioner 34 is tightened or loosened by adjusting the length of the cable ties 38 that form the length-adjustable portion of the adjustable tensioner 34. As the cable ties 38 are shortened to increase tension in the friction material 32, the friction material 32 is pressed with increasing force against an outermost layer of the stretch film 28, in the direction that is radially inward toward the stretch film roll's rotational axis. It will be appreciated that when no stretch film roll 26 is present, such as shown in FIGS. 9 and 10, the friction material 32 may hang loosely and have little or no tension applied to it by the adjustable tensioner 34, but when a stretch film roll 26 is installed, the diameter of the stretch film roll is sufficient to urge the friction material 32 radially outward, relative to the rotational axes of both the wrapping wheel 16 and the stretch film roll 26, so that the friction material 32 becomes adequately tensioned upon installation of the stretch film roll 26.

Because the springs 36 are stretched when the stretch film roll 26 is installed at the roll mount 24 and the desired lengths of cable ties 38 are set, the springs 36 can generally maintain a suitable amount of tension in the friction material 32 for both a full stretch film roll (relatively large diameter) and a nearly empty stretch film roll (relatively small diameter). Because some variation in the tension applied to the stretch film 28 is usually tolerable during wrapping operations, the lengths of cable ties 38 (or other length-adjustable component) may be selected and set so that the tension in friction material 32 (and therefore, in the stretch film 28 being applied to the product being wrapped) is optimal when the stretch film roll 26 is approximately half empty. This will generally result in the tension being greater than optimal when the stretch film roll 26 is full (i.e., at its maximum diameter), and the tension being lower than optimal when the stretch film roll 26 is nearly empty (i.e., at its minimum diameter). However, the greater-than-optimal tension for a full roll and the lower-than-optimal tension for an empty roll may still provide acceptable levels of stretch in the stretch film 28 being applied to the product for the full roll of stretch material. If needed or desired, it would be possible to manually shorten the lengths of the cable ties 38 when the rolls 26 have been partially used and the wrapping wheel 16 is stopped, to more closely maintain optimal tension as the stretch film contents of the rolls are used up. Although it is envisioned and contemplated that more sophisticated tensioners, such as servo actuators or fluid-actuated piston actuators, may be used to maintain a constant or nearly-constant tension in the friction material 32 as the diameter of the stretch film roll 26 decreases during wrapping operations, these would typically be higher cost tensioners and may provide only marginally different performance compared to the film tensioning system 30 described herein.

Figure 6:
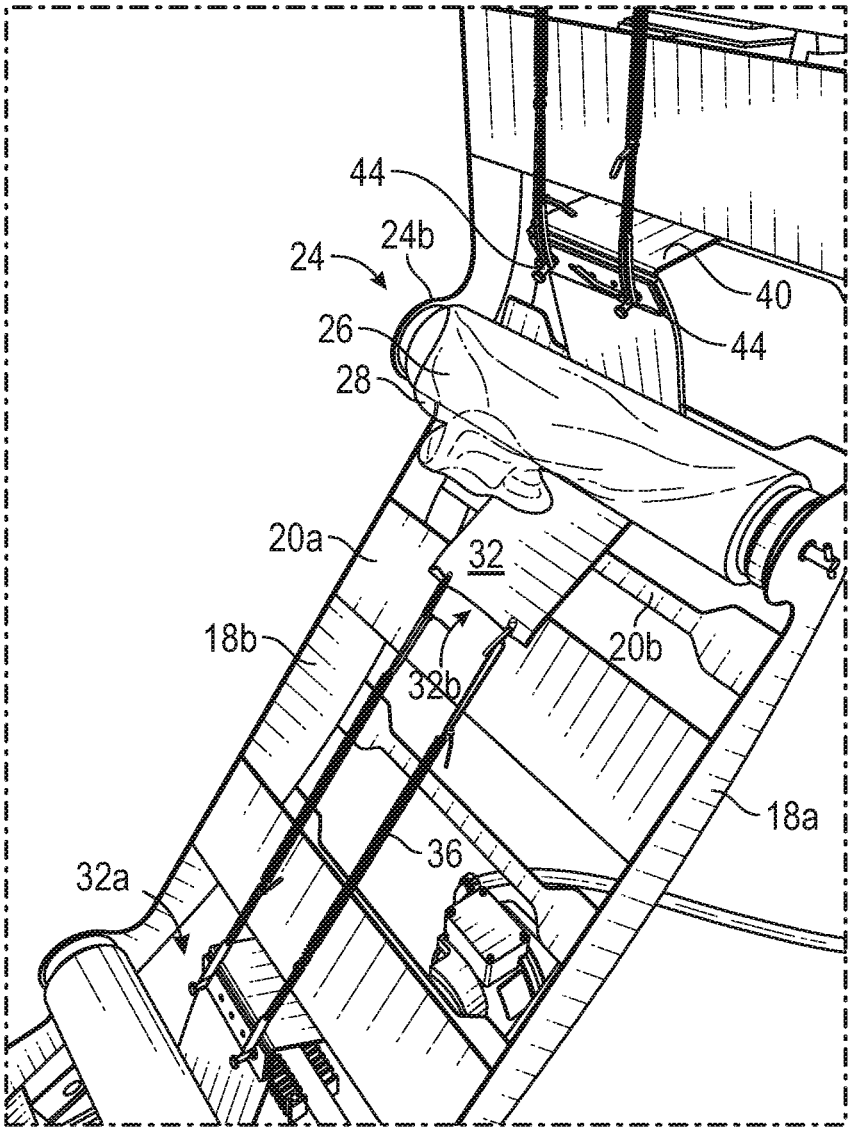
FIG. 6 is an enlarged perspective view of a stretch film roll and tensioning system along a portion of the wrapping wheel of FIG. 4.
Figure 7:
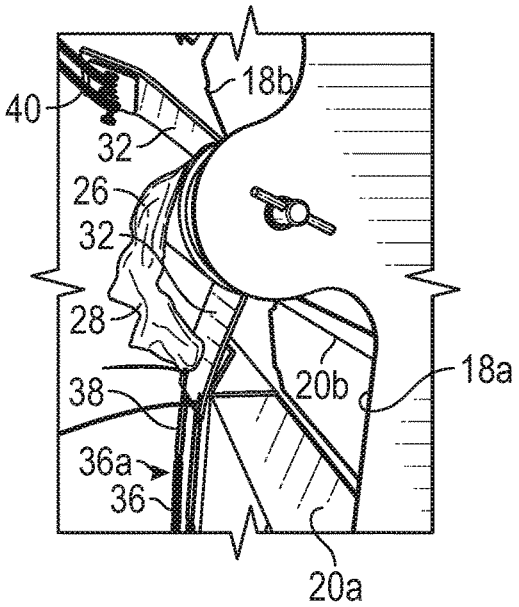
FIG. 7 is a side perspective view of the stretch film roll and tensioning system along a portion of the wrapping wheel of FIG. 4.
Figure 8:
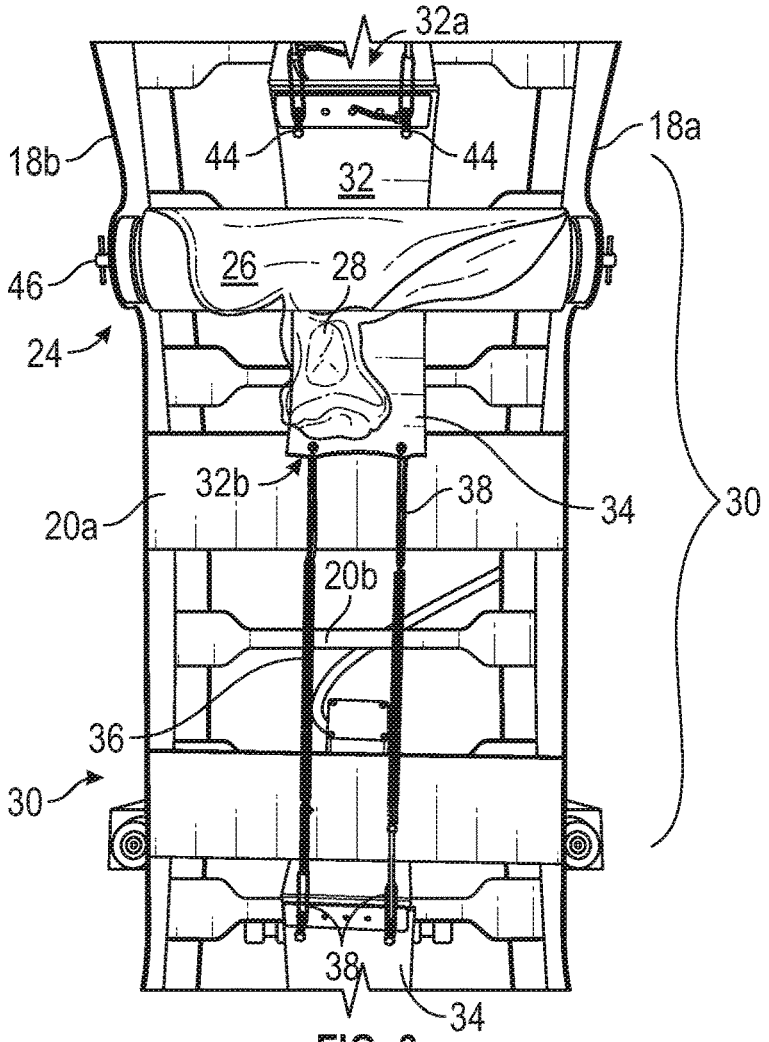
FIG. 8 is a top perspective view of the stretch film roll and tensioning system along a portion of the wrapping wheel of FIG. 4.

In the illustrated embodiment, the friction material 32 is a generally rectangular and flat strip of natural leather having a width that is approximately one-third the length of stretch film roll 26, such as shown in FIG. 8. Other suitable materials may include natural or synthetic materials, including woven fabric or webbing, or composite materials, and preferably having sufficiently low coefficients of friction with stretch film 28 to permit the tensioning system 30 to be manually adjusted without causing small tension adjustments to result in large changes in the frictional load applied to the outermost layer of stretch film 28 on the stretch film roll 26. The width of friction material 32 may be selected according to its frictional properties when engaged with the stretch film 28, the need to dissipate heat into the stretch film still present on the stretch film roll 26, abrasion mitigation, and other factors. Referring to FIGS. 6-9, each piece of friction material 32 has a first end 32*a* that is held fixed relative to wrapping wheel 16 by a clamp bracket 40 that is mounted to (or formed at least partially by) one of the inner wheel brackets 20*a*. The second or opposite end 32*b* of the friction material 32 has a pair of holes 42 punched through it, which holes 42 may optionally be reinforced with metal grommets or the like. Cable ties 38 or other mechanical attachment devices are inserted through the holes 42 and attached to one end 36*a* of a respective coil spring 36. It is further envisioned that, instead of securing the friction material 32 at holes 42, another clamp bracket, similar to clamp bracket 40, may be used to hold the opposite end 32*b* of the friction material 32. The opposite end 36*b* of the coil spring 36 is secured to another clamp bracket 40 by additional cable ties 38 that are looped over respective studs 44 on that clamp bracket 40, such as shown in FIGS. 6-8. Thus, in the illustrated embodiment each coil spring 36 is held by a length-adjustable member 38 (cable tie) at each end 36*a*, 36*b* of the spring, such that the tension in the spring (and, thus, in the corresponding cable ties 38 and friction material 32) may be set by adjusting the length of any of the cable ties 38 to which that spring 36 is attached.

Figure 11:
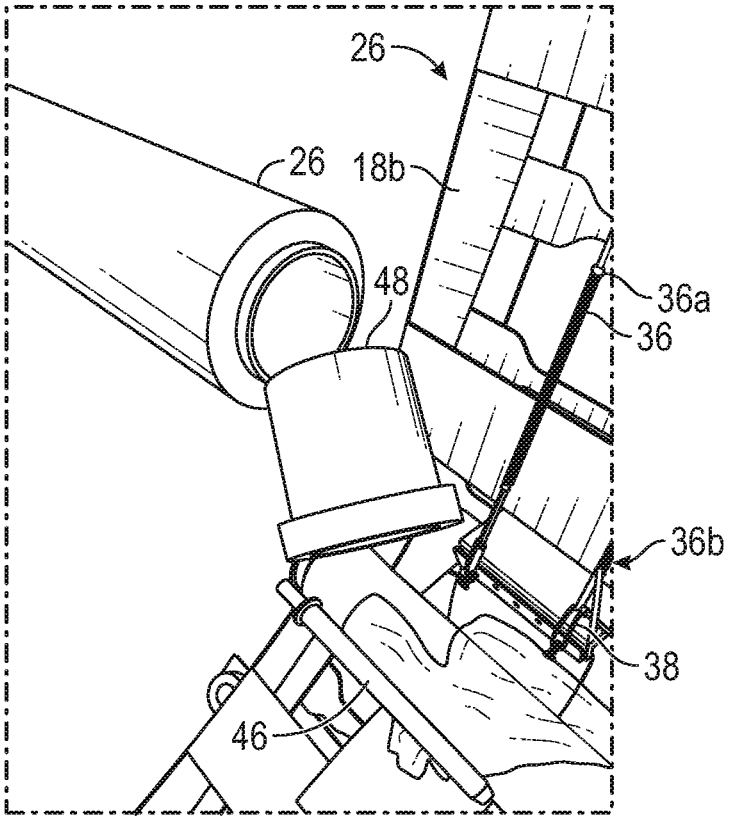
FIG. 11 is a perspective view of a stretch film roll with a mounting spindle end cap removed.

In the illustrated embodiment, and as best shown in FIGS. 4 and 5, wrapping wheel 16 supports eight stretch film rolls 26 at respective roll mounts 24, although a larger or smaller number of roll mounts 24 and/or stretch film rolls 26 may be used. Optionally, fewer than all of the available roll mounts 24 may be fitted with stretch film rolls 26, depending on the nature of the desired wrapping operation, and the orbital wrapping machine may be sized to accommodate substantially any desired application, from a tabletop wrapping machine for small articles, to a much larger wrapping machine for wrapping vehicles, industrial machinery, and any other items for which plastic film wrapping is desired. As shown in FIGS. 6-10, the roll mount portions 24*a*, 24*b* may be formed as radially-inwardly directed extensions or projections of the circular loops 18*a*, 18*b* that form wrapping wheel 16. The roll mount portions 24*a*, 24*b* define bores that receive spindles 46, which extend into the space defined between the roll mount portions 24*a*, 24*b* and engage respective mounting spindle end caps 48 (FIGS. 10 and 11), thus permitting the corresponding stretch film roll 26 to be rotatably supported between the circular loops 18*a*, 18*b* of the wrapping wheel 16.

Figure 12:
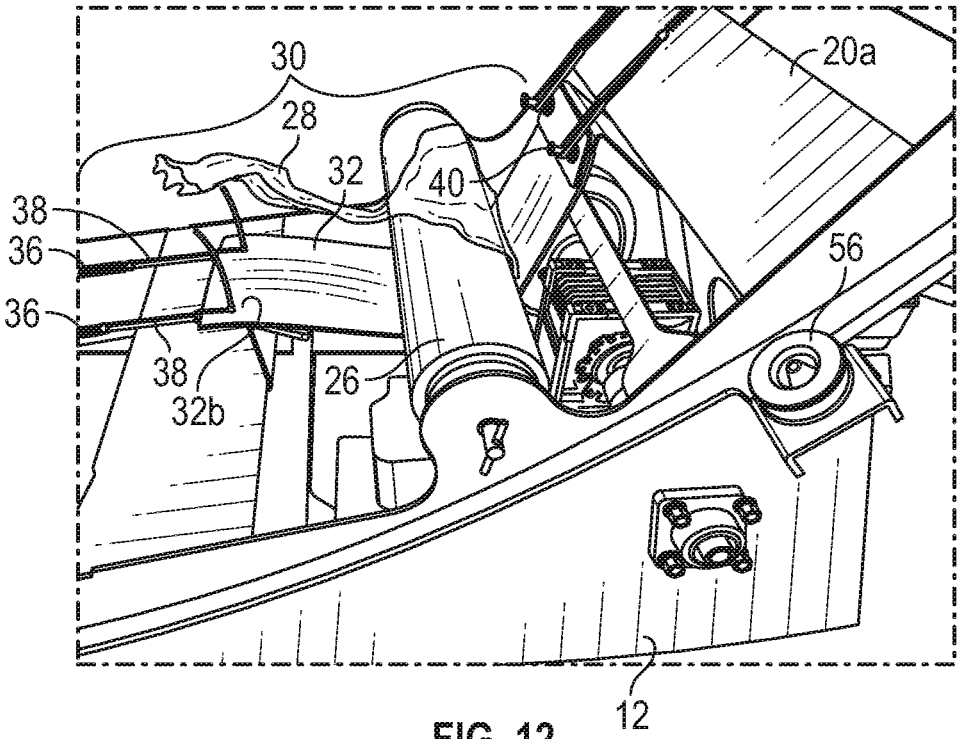
FIG. 12 is another perspective view of the stretch film roll and tensioning system along a a portion of the wrapping wheel of FIG. 4.
Figure 13:
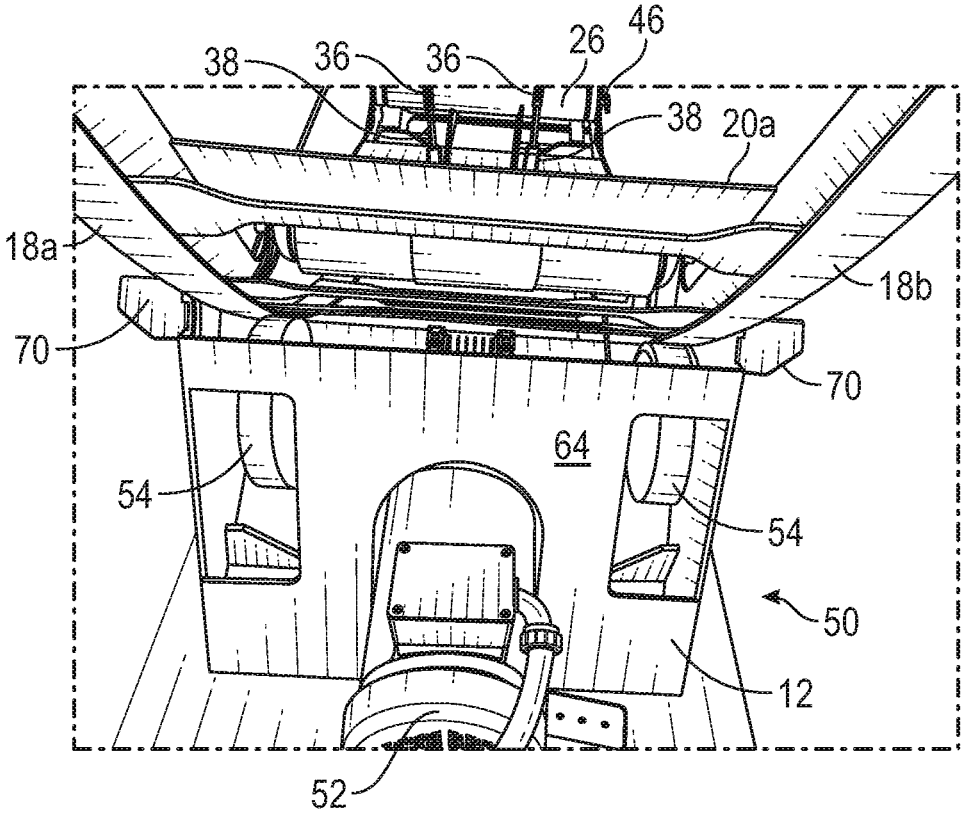
FIG. 13 is a perspective view of an exterior portion of the wrapping wheel and side portion of the wheel-support base with drive motor.
Figure 14:
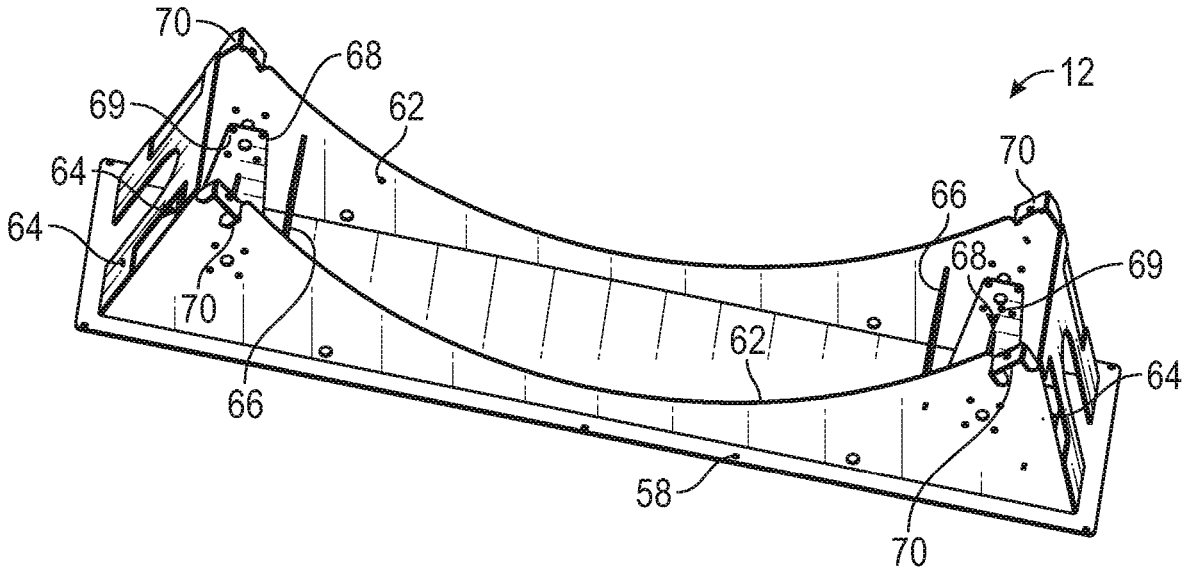
FIG. 14 is a perspective view of the wheel-support base.

A powered drive system 50 including an electric motor 52 is provided along the support base 12 to rotatably drive the wrapping wheel 16 relative to the support base, such as shown in FIG. 13. A pair of drive wheels 54 are rotatably driven by motor 52, and each wheel 54 frictionally engages an outer surface of a respective circular loop 18*a*, 18*b*, to thereby drive the wrapping wheel 16. A plurality of idler wheels (including side-engaging guide wheels 56 of FIGS. 4, 5 and 12) are rotatably mounted along support base 12, and facilitate stable rotation of wrapping wheel 16 when motor 52 is energized. Although the illustrated embodiment includes powered drive system 50, it will be appreciated that a manual drive system may be adequate for low volume operations, for relatively small orbital wrappers, or for wrapping systems with only a small number of stretch film rolls 26, since all of these factors would reduce the power required to rotate the wrapping wheel 16. A manual drive system may include a crank handle and gear train, a grasping knob attached to one of the circular loops, a rotatable friction wheel, or the like.

Support base 12 includes a rectangular base plate 58 that rests upon a floor surface (and may be bolted to the floor surface), or that may be elevated above the floor surface by a pair of uprights 60 associated with the wheel housing 14, such as shown in FIGS. 1-3. A pair of sidewalls 62 are arranged lengthwise relative to the base plate 58, and extend upwardly therefrom. Sidewalls 62 have arcuate concave-up upper edges that generally follow the shape of the wrapping wheel 16. A pair of end walls 64 are coupled between the sidewalls 62 at opposite ends thereof, one or both of which may provide mounting surfaces for the components of powered drive system 50. Support brackets 66 and support braces 68 (including bearing mounts 69) are provided for structural support and/or for mounting drive wheels 54, idler wheels, or other components. Side wheel mounting tabs 70 are provided at the upper corners of sidewalls 62 for mounting the side-engaging guide wheels 56.

Wheel housing 14 includes an upper housing portion 14*a* that is generally shaped as a semi-circle in an inverted-U (concave-down) orientation, and a lower housing portion 14*b* that is generally U-shaped with a concave-up semi-circular surface and squared lower region (FIGS. 1-3). Lower housing portion 14*b* may be formed from multiple non-structural panel components assembled together with structural uprights 60 and horizontal cross-beams 72 providing structural support for the support base 12 and wrapping wheel 16. A pair of notches or gaps 74 are centrally formed at the bottom of the lower housing portion 14*b*, and provides operators access to the circular loops 18*a*, 18*b* and spindles 46, such as to facilitate exchanging full stretch film rolls 26 for empty stretch film spools.

Accordingly, the orbital wrapping machine 10 provides a relatively simple and low cost system for wrapping individual products or articles, groups of products or articles, and/or shipping/storage pallets and their contents, with plastic film (preferably stretch film) that is properly tensioned during the wrapping operation. The wrapper 10 is operated by installing a desired number of stretch film rolls 26 at respective roll mounts 24, setting each film tensioning system 30 to achieve a desired frictional resistance against rotation of each roll 26, inserting one or more products or articles to be wrapped (including palletized products) into the wrapping chamber 22, attaching a free end of stretch film 28 from each roll 26 to the pallet or the product(s) or article(s) to be wrapped, and energizing the powered drive system 50 to spin wrapping wheel 16 around the article(s) or the pallet and product(s). The article(s) or pallet and product(s) can be moved along the rotational axis of the wrapping wheel 16 as it spins, to ensure adequate coverage of the product(s) with the stretch film 28. As the wrapping wheel 16 spins, the frictional force imparted to each roll 26 causes the stretch film 28 to stretch as it is drawn off its respective roll and results in compressive loads being applied to the article(s) or palletized product(s) to secure them, while also helping to ensure a weather-resistant layer of applied stretch film 28 when the wrapping operation is complete.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. An orbital wrapping machine comprising:

a wrapping wheel defining an interior wrapping chamber;

a support base configured to rotatably support said wrapping wheel;

a roll mount disposed along said wrapping wheel and configured to rotatably support a roll of stretch film, said roll mount defining a roll rotation axis; and a film tensioning system comprising:

a friction material spaced from said roll rotation axis and configured to engage an outer surface of the roll of stretch film; and a manual adjuster coupled to said friction material and operable to urge said friction material against the outer surface of the roll of stretch film at different levels of pressure when the roll of stretch film is rotatably supported at said roll mount;

wherein rotation of said wrapping wheel causes the stretch film to be payed out from the roll under tension that is imparted by frictional engagement of the friction material with the roll of stretch film;

wherein said friction material comprises an elongate strip having opposite ends positioned at opposite sides of said roll mount and said roll rotation axis, and a middle portion for engaging the outer surface of the roll of stretch film;

wherein said manual adjuster comprises a tensioner having a first end portion coupled to said wrapping wheel and a second end portion coupled to one of said ends of said friction material, and wherein said tensioner is operable to increase and decrease a tension in said elongate strip; and wherein said tensioner comprises an elastic member and a length-adjustable member, wherein said elastic member stretches in response to shortening of said length-adjustable member.

2. The orbital wrapping machine of claim 1, further comprising the roll of stretch film, wherein said elongate strip has a width of approximately one-third of the length of said roll of stretch film.

3. The orbital wrapping machine of claim 1, wherein said elastic member comprises a coil spring.

4. The orbital wrapping machine of claim 1, wherein said friction material frictionally engages the roll of stretch film with increasing force in response to shortening of said length-adjustable member.

5. The orbital wrapping machine of claim 1, wherein said elongate strip comprises a substantially flat sheet of flexible material.

6. The orbital wrapping machine of claim 5, wherein said substantially flat sheet of flexible material comprises leather.

7. The orbital wrapping machine of claim 1, comprising a plurality of said roll mounts and a corresponding plurality of said film tensioning systems spaced circumferentially along said wrapping wheel.

8. The orbital wrapping machine of claim 1, further comprising a drive system configured to rotatably drive said wrapping wheel and a plurality of idler wheels at said support base for supporting said wrapping wheel.

9. The orbital wrapping machine of claim 8, wherein said drive system comprises a drive motor and a drive wheel at said support base, wherein said drive motor is operable to rotatably drive said drive wheel.

10. An orbital wrapping machine comprising:

a wrapping wheel defining an interior wrapping chamber and a wheel axis through said wrapping chamber;

a drive system operable to rotate said wrapping wheel about said wheel axis;

a roll mount disposed along said wrapping wheel and configured to rotatably support a roll of stretch film along a roll axis; and a film tensioning system at said roll mount, said film tensioning system comprising:

an elongate strip of friction material having opposite ends coupled to said wrapping wheel at opposite sides of said roll axis and a middle portion configured to engage an outer surface of the roll of stretch film; and a manual tension adjuster coupled to said elongate strip of friction material and operable to selectively increase tension in said elongate strip of friction material and urge said middle portion friction material against the outer surface of the roll of stretch film at different levels of pressure when the roll of stretch film is rotatably supported at said roll mount;

wherein said manual tension adjuster comprises a first end portion coupled to said wrapping wheel and a second end portion coupled to one of said ends of said friction material, and wherein said manual tension adjuster is operable to increase and decrease a tension in said elongate strip of friction material; and wherein said manual tension adjuster comprises an elastic member and a length-adjustable member, wherein said elastic member stretches in response to shortening of said length-adjustable member.

11. The orbital wrapping machine of claim 10, wherein said roll mount comprises a plurality of roll mounts disposed circumferentially along said wrapping wheel.

12. The orbital wrapping machine of claim 11, wherein said film tensioning system comprises one of said elongate strip of friction material and a corresponding one of said manual tension adjusters disposed circumferentially along said wrapping wheel at respect and each of said roll mounts.

13. The orbital wrapping machine of claim 10, wherein said elongate strip of friction material frictionally engages the roll of stretch film with increasing force in response to shortening of said length-adjustable member.

14. The orbital wrapping machine of claim 10, further comprising support base configured to rotatably support said wrapping wheel in an upright orientation with said wheel axis in a generally horizontal orientation, said support base comprising a plurality of idler wheels for supporting said wrapping wheel, and said drive system comprising at least one powered drive wheel for rotatably driving said wrapping wheel.

15. The orbital wrapping machine of claim 14, wherein said drive system comprises a drive motor at said support base, wherein said drive motor is operable to rotatably drive said drive wheel.

* * * * *